US005845902A

United States Patent [19]

Takemoto

[11] Patent Number: 5,845,902

[45] Date of Patent: Dec. 8, 1998

[54] COMPUTER SYSTEM IN A GAMING HOUSE

[75] Inventor: Takatoshi Takemoto, Tokyo, Japan

[73] Assignee: Kabushiki Kaisha Ace Denken, Tokyo, Japan

[21] Appl. No.: 947,724

[22] Filed: Oct. 23, 1997

Related U.S. Application Data

[63] Continuation of Ser. No. 553,310, filed as PCT/JP94/00775 May 13, 1994, abandoned.

[30] Foreign Application Priority Data

May 18, 1993 [JP] Japan ..... 5-116174

[51] Int. Cl.[6] ..... A63F 9/24; A63F 7/30

[52] U.S. Cl. ..... 273/121 B; 273/138.1; 273/139

[58] Field of Search ..... 463/1–3, 16, 20, 463/25, 29–31, 40–43; 364/410.1, 412.1; 273/118 R–119 R, 121 A, 121 R, 121 B, 119 A, 123 R, 127 R, 118, 138.2, 138.1, 139

[56] References Cited

U.S. PATENT DOCUMENTS

| | | | |
|---|---|---|---|
| 4,521,014 | 6/1985 | Sitrick | 463/40 |
| 4,572,509 | 2/1986 | Sitrick | 463/42 |
| 4,964,638 | 10/1990 | Ishida | 463/42 |
| 5,131,655 | 7/1992 | Ugawa | 273/121 A |
| 5,429,361 | 7/1995 | Raven et al. | 463/25 |

FOREIGN PATENT DOCUMENTS

| | | | |
|---|---|---|---|
| 61-179181 | 8/1986 | Japan | A63F 7/02 |
| 3-205079 | 9/1991 | Japan | A63F 7/02 |
| 3-205080 | 9/1991 | Japan | A63F 7/02 |
| 4-189380 | 7/1992 | Japan . | |
| 4-189380 A | 7/1992 | Japan . | |
| 92/04954 | 4/1992 | WIPO | A63F 7/02 |

OTHER PUBLICATIONS

Translation of JP 04–189380, entitled "Slot Machine (Pachinko Machine)" as Translated by FLS, Inc. PTO 98–2665.

*Primary Examiner*—Jessica J. Harrison
*Assistant Examiner*—Mark A. Sager
*Attorney, Agent, or Firm*—Seed and Berry LLP

[57] ABSTRACT

A computer system in a gaming house has matrix controllers 100 of detection control sections, each being placed in each of a plurality of gaming machines, for controlling detection of game play media of the gaming machines and a hall management computer 200 of a gaming house control section communicating with the matrix controllers 100 for controlling the matrix controllers 100. Each of the matrix controllers 100 comprises a matrix sensor for sensing game play media of the gaming machines, storage means for storing detection positions to detect the game play media, determination means for determining that a game play medium is detected by the matrix sensor at one of the detection positions stored in the storage means, and outputting detection information, a transmission-reception circuit for transmitting the detection information output by the determination means to the hall management computer 200 and receiving detection position specification from the hall management computer 200, and setting means for setting the received detection position in the storage means.

11 Claims, 6 Drawing Sheets

| DETECTION POSITION (X, Y) | SET UP INFORMATION FOR DETECTION POSITION |
|---|---|
| (15, 15) | PROPELLED PINBALL COUNT SET UP SET UP POINT 13 |
| (20, 600) | WINNING HOLE S1 (15 PINBALLS) |
| (25, 150) | WINDMILL 17 |
| (1000, 600) | OUT HOLE 18 |
| ⋮ | |

*Fig. 7*

COMPUTER SYSTEM IN A GAMING HOUSE

CROSS-REFERENCE TO RELATED APPLICATION

This application is a continuation of U.S. patent application No. 08/553,310, filed Nov. 20, 1995, now abandoned, which is a 371 application of PCT JP94/0075, filed May 13, 1994.

1. Technical Field

This invention relates to a computer system for managing gaming machines in a gaming house having gaming machines such as pachinko ball machines (Japanese pinball machines), arrange balls, and mah-jongg pinball machines using game play media.

2. Technical Background

As a conventional example of a computer system in a gaming house, an art is disclosed in Japanese Patent Laid-Open Nos. Hei 3-205080 and 3-205079, wherein an electronic management system using detectors provided for each gaming machine to detect information concerning game play media of the gaming machines for managing the gaming machines collects the information concerning game play media detected by the detectors and performs operations on the information.

Matrix sensors are used as some of the detectors used in the art. As a conventional example related to the matrix sensor, an art is disclosed in International Laid-Open No. WO92/04954 pamphlet.

With some gaming machines, a player moves a metallic body, such as a metal ball, in a specific space set in the gaming machine and may or may not win the play depending on the destination of the metal ball. Pinball machines are typical example of such gaming machines; with a pinball machine, a player plays a game by dropping a pinball made of metal into a space sandwiched between parallel planes in which a large number of obstacles are located.

A general pinball machine has a base board for providing a space required to move pinballs, a glass plate spaced from the base board at a given interval to cover the base board, and a propelling mechanism for propelling pinballs into the top of the base board. The pinball machine is set up so that the base board becomes substantially parallel to the vertical direction. The base board of the gaming machine is formed with a plurality of holes for discharging pinballs of game play media from the base board; specific holes are used as winning holes and when a pinball enters one of the winning holes, pinballs are paid out to the player for the winning game play. A hole, into which pinballs that have not entered the winning holes are finally collected for discharging the pinballs, is used as an out hole. Hereinafter, pinballs entering the winning holes will be referred to as winning balls and pinballs entering the out hole as out balls.

A large number of pins (nails) are set up substantially vertical to the base board in a state in which they project from the base board as far as the diameter of a pinball, and they act as obstacles with which pinballs dropping along the base board frequently collide for causing their motion direction to fluctuate. The pins are located on the base board with a distribution determined so as to guide pinballs colliding with the pins toward or away from the winning holes while causing the motion directions of the pinballs to fluctuate.

The above-mentioned matrix sensor senses whether or not a pinball exists at a predetermined position. A matrix controller for controlling the matrix sensor can calculate the number of pinballs detected at each position. It is provided with storage means for storing the positions of the propelling mechanism, winning holes, and out hole in relation to the matrix; these positions are preset in the storage means. The matrix sensor detects winning balls, out balls, and propelled balls at matrix setting positions of the matrix sensor, and the matrix controller can calculate the numbers of the detected winning balls, out balls, and propelled balls.

If the detection positions are set in the storage means for the gaming machine provided with the matrix sensor, pinballs at the setup positions can be detected. However, when gaming machines are replaced in the gaming house, the matrix sensor is adapted to be removed from the gaming machine and mounted on a new one for use. This means that the matrix sensor is designed to be applicable to any gaming machines (pinball machines). Since the detection positions of winning balls, out balls, and propelled balls vary from one gaming machine to another, it becomes necessary to again set the detection positions in the storage means. Hitherto, to set the detection positions in the storage means, a driver on which a storage medium such as a floppy disk or an IC card is mounted has been provided for the matrix controller, and information on the detection positions stored on the storage medium has been read. That is, each time a gaming machine is replaced, the storage medium on which the detection positions are set in accordance with the gaming machine type is mounted on the driver of the matrix controller in accordance with a new gaming machine for setting detection positions. Thus, as the number of gaming machines in the gaming house increases, it takes an enormous amount of labor to set the positions.

The matrix controller performs operations on detected information. The operation procedures are predetermined and changing the operation procedures involves a similar problem to changing the detection positions described above.

DISCLOSURE OF THE INVENTION

It is therefore an object of the invention to provide a computer system for facilitating setting of the detection positions of the detection means in each gaming machine. It is another object of the invention to provide a computer system for facilitating setting of processing procedures of information detected by the detection means in each gaming machine.

To these ends, according to the invention, there is provided a computer system in a gaming house having a plurality of gaming machines for players to play games with game play media, the computer system comprising:

detection control sections, each being placed in each of the gaming machines, for controlling detection of the game play media of the gaming machines; and a gaming house control section communicating with each of the detection control sections for controlling the detection control sections, characterized in that each of the detection control sections comprises:

means for sensing the game play media at a plurality of sensing positions of the gaming machine;

means for storing detection positions to detect the game play media;

determination means for determining that one of the game play media is detected by the detection means at one of the sensing positions corresponding to the detection positions stored in the storage means, and outputting detection information indicating that the game play medium is detected at the detection position;

means for transmitting at least the detection information output by the determination means to the gaming house control section;

means for receiving detection position information specifying the detection positions from the gaming house control section; and setting means for storing, in the storage means, the detection positions specified by the detection position information received at the reception means, and that the gaming house control section comprises:

means for inputting the detection position information;

means for transmitting at least the detection position information input through the input means to each of the detection control sections;

means for receiving at least the detection information from the detection control sections; and means for processing the detection information received at the reception means.

In the computer system in a gaming house according to the invention, first the detection position information is input through the input means of the gaming house control section. If the input means comprises read means, it is input by reading information concerning the detection positions from a storage medium storing the detection position information. When information is input through the input means, the transmission means transmits at least the input information concerning the detection positions.

In each detection control section, when the detection position information is transmitted from the transmission means of the gaming house control section, it is received at the reception means and the setting means stores and sets the detection position information in the storage means.

If a player plays a game after setting, the detection control section detects game play media of the gaming machine. The determination means determines that one of game play media is detected by the detection means at one of the detection positions stored in the storage means, and outputs detection information indicating that the game play medium is detected at the detection position. The detection information processing means processes the detection information output by the determination means, and outputs the processing result. The transmission means of the detection control section transmits the processing result output by the detection information processing means.

The reception means of the gaming house control section receives the processing result. The processing means performs processing based on the processing result received at the reception means.

The detection positions in the detection control sections can be set from the gaming house control section by performing processing as described above.

To this end, according to the invention, there is provided a computer system in a gaming house having a plurality of gaming machines for players to play games with game play media, the computer system comprising:

detection control sections, each being placed in each of the gaming machines, for controlling detection of the game play media of the gaming machines; and a gaming house control section communicating with each of the detection control sections for controlling the detection control sections, characterized in that each of the detection control sections comprises:

means for sensing the game play media at a plurality of sensing positions of the gaming machine;

means for storing detection positions to detect the game play media;

determination means for determining that one of the game play media is detected by the detection means at one of the sensing positions corresponding to the detection positions stored in the storage means, and outputting detection information indicating that the game play medium is detected at the detection position;

means for storing predetermined processing procedures;

detection information processing means for processing the detection information output by the determination means according to the processing procedure stored in the processing procedure storage means, and outputting the processing result;

means for transmitting at least the processing result output by the detection information processing means to the gaming house control section;

means for receiving a processing procedure transmitted from the gaming house control section; and setting means for storing the processing procedure received at the reception means in the processing procedure storage means, and that the gaming house control section comprises:

means for inputting a processing procedure in the detection information processing means;

means for transmitting at least the processing procedure input through the input means to each of the detection control sections;

means for receiving at least the processing result from the detection control sections; and means for processing the processing result received at the reception means.

According to the computer system in a gaming house, the input means inputs a processing procedure in the detection information processing means, and the transmission means of the gaming house control section transmits the processing procedure input through the input means.

On the other hand, the reception means of the detection control section receives the processing procedure transmitted by the transmission means of the gaming house control section, and the setting means sets the processing procedure received at the reception means in the processing procedure storage means. The detection information means processes the detection information output by the determination means according to the processing procedure stored in the processing procedure storage means, and outputs the processing result. The transmission means of the detection control section transmits the processing result output by the detection information processing means.

The reception means of the gaming house control section receives the processing result, and the processing means performs processing based on the processing result received at the reception means.

The processing procedures in the detection control sections can be set and changed from the gaming house control section by performing processing as described above.

BRIEF DESCRIPTION OF THE DRAWINGS

In the accompanying drawings:

FIG. 7 is an illustration of information indicating detection positions.

BEST MODE FOR CARRYING OUT THE INVENTION

Referring now to the accompanying drawings, there is shown the best mode for carrying out the invention as an embodiment of the invention.

Figure 3:
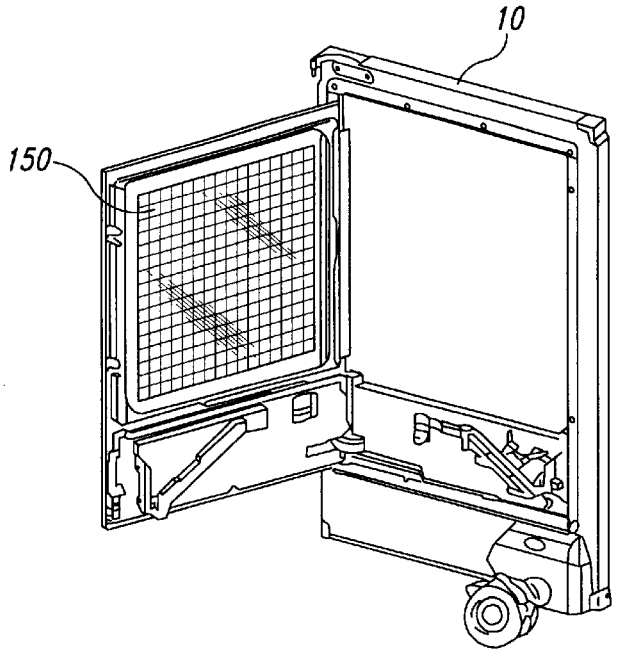
FIG. 3 is an external view of a gaming machine in which detection means is placed.
Figure 4:
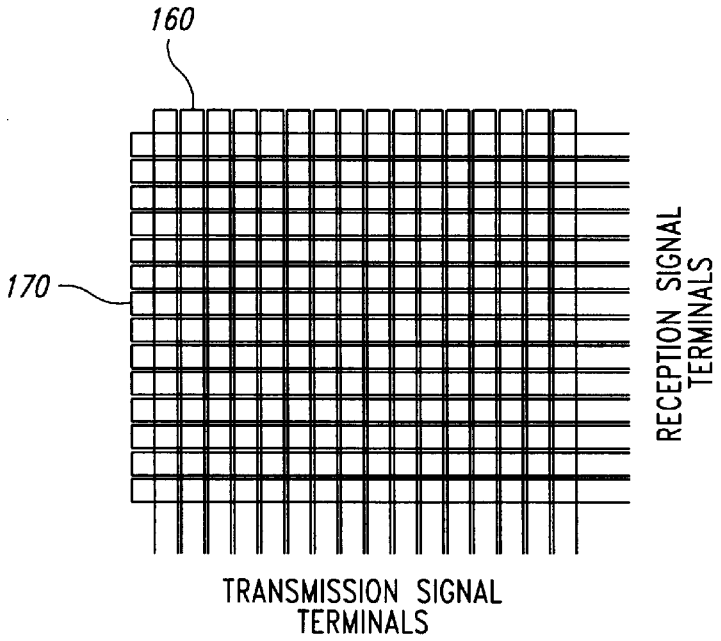
FIG. 4 is a drawing showing the structure of a matrix.

In the embodiment, a metal sensor like a matrix is used as detection means for detecting game play media, and is installed in a gaming machine. FIG. 3 is an external view of a gaming machine in which the detection means is installed. FIG. 4 is a drawing showing the matrix structure when the matrix sensor is used as the detection means. In FIG. 3, a pinball machine is used as a gaming machine 10.

The gaming machine 10 has a base board for providing a space required to move metallic bodies of game play media, a glass lid spaced from the base board at a given interval to cover the base board, and a propelling mechanism for propelling metallic bodies B into the top portion of the base board. The gaming machine 10 is set up so that the base board becomes substantially parallel to the vertical direction. As shown in FIGS. 3 and 4, the matrix sensor making up the metal sensor is placed along the base board of the gaming machine 10. It is disposed on an inner glass substance when viewed from the gaming machine 10, which is on the side of the base board, of surface and inner glass substances making up the front glass lid covering the base board.

As shown in FIG. 4, a transmission coil group 160 has a plurality of parallel transmission lines making a U turn and placed in one direction on the same plane. Likewise, a reception coil group 170 has a plurality of parallel reception lines making a U turn and placed in one direction on the same plane.

The reception coil group 170 is placed near the transmission coil group 160 so that it can be coupled electromagnetically with the transmission coil group 160. That is, it is placed in a crossing direction at right angles to plane parallel positions with the transmission coil group 160 (namely, with the plane containing the turned transmission coil group 160 made parallel with the plane containing the turned reception coil group 170) so that an electromagnetic characteristic changes when metal, such as a metallic body B, approaches.

The transmission coil group 160 and the reception coil group 170 of the matrix sensor are connected to a matrix controller which transmits signal current for causing a magnetic field to be generated on each transmission line in sequence and detects a magnetic flux change caused by metal approaching each reception line. The number of sensing units can be set to, for example, 1024 in total (32 rows of transmission lines×32 columns of reception lines), and the sensing position can be indicated by coordinates for each of the sensing units.

The matrix controller 100 sends a transmission signal to the transmission coils one at a time through transmission signal terminals, and meanwhile scans the reception coils one at a time through reception signal terminals for checking whether or not a signal exists, to thereby detect a game play medium. When a signal is detected, the matrix controller 100 detects the position of the game play media based on the transmission coil number and reception coil number. For the transmission and reception coils, X and Y axes may be opposite. Further, the coordinates indicating the positions of winning holes and an out hole are prestored as detection positions to detect game play media. The matrix controller 100 carries out detection, and when a game play medium on the base board disappears in one place, it can detect into which winning hole or out hole the game play medium entered.

Figure 1:
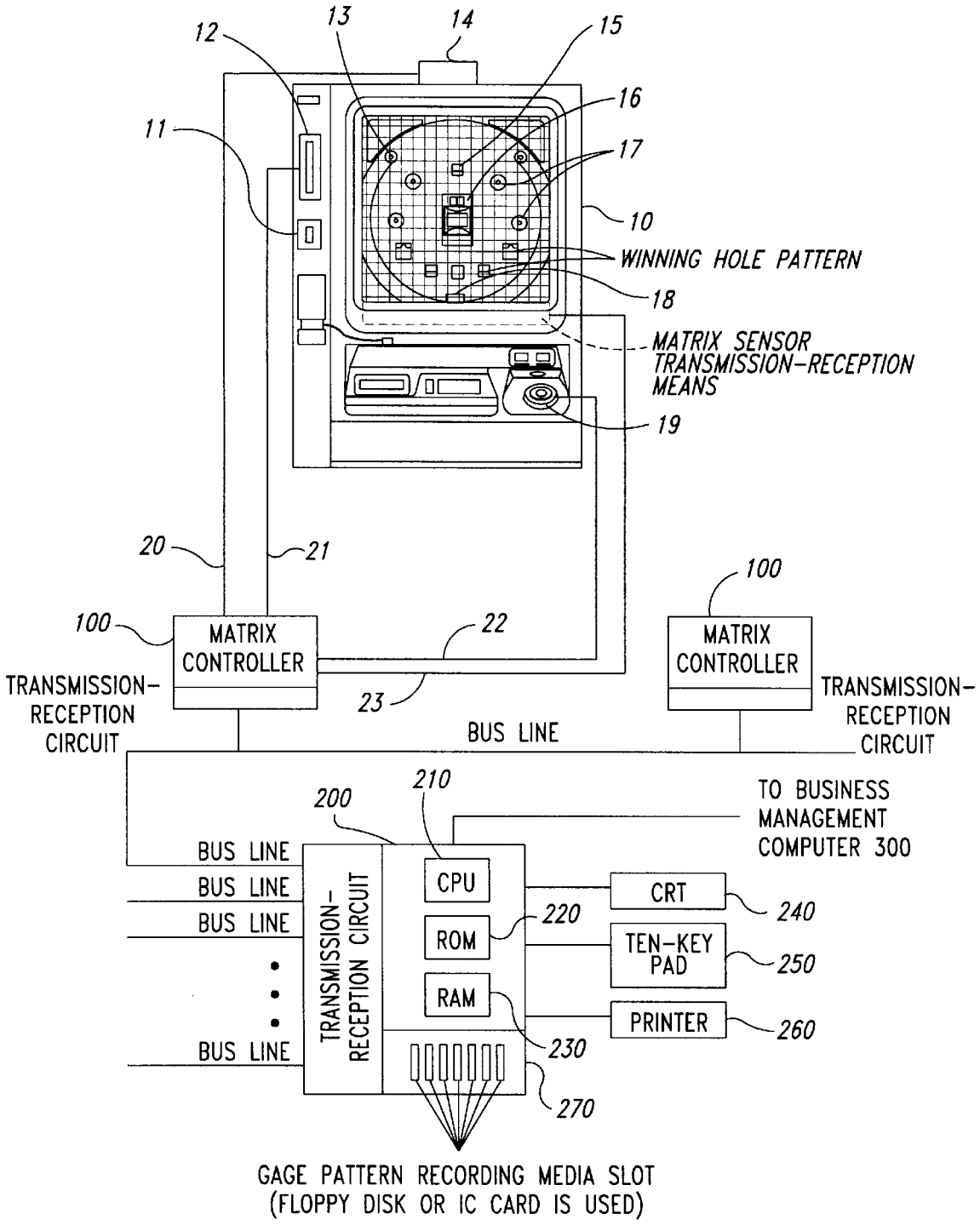
FIG. 1 is a block diagram of a computer system in a gaming house.
Figure 2:
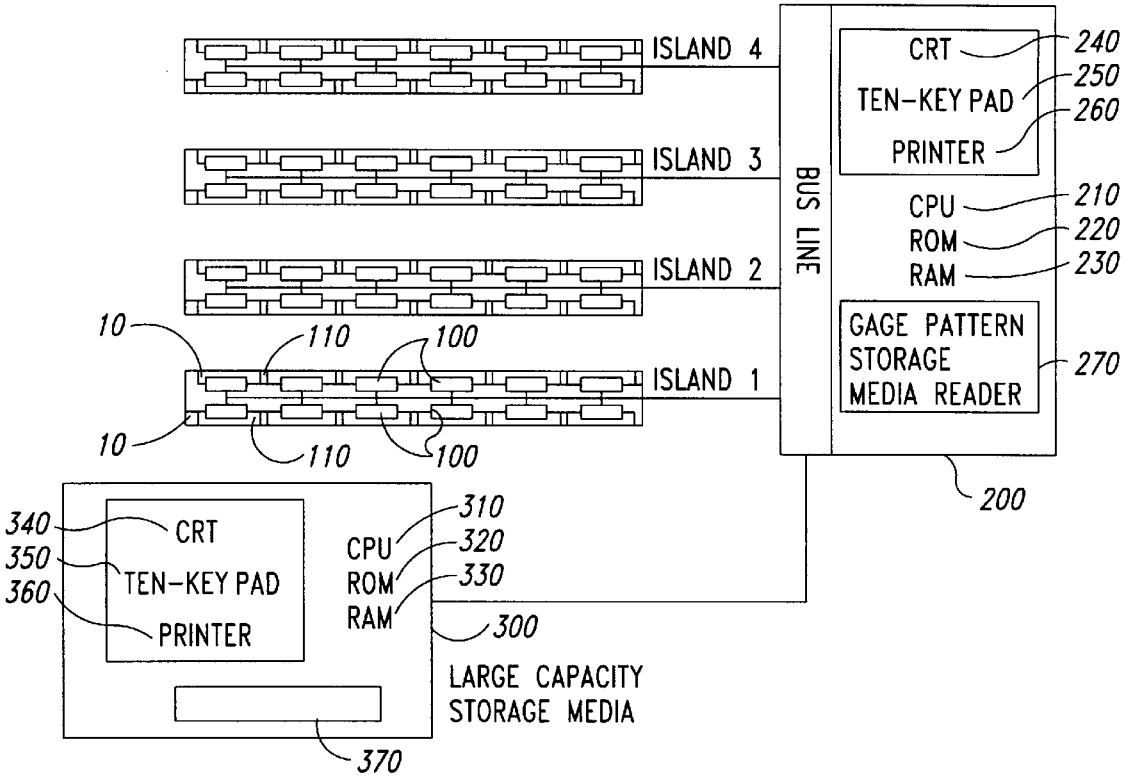
FIG. 2 is an overall block diagram of the computer system.

Next, a computer system of the embodiment will be discussed. FIG. 1 is a block diagram of the computer system in a gaming house. FIG. 2 is an entire block diagram of the computer system, wherein a plurality of gaming machines make up an island.

In FIGS. 1 and 2, the computer system in the gaming house has matrix controllers 100 of detection control sections, each being placed in each of the gaming machines, for controlling detection of game play media of the gaming machines and a hall management computer 200 of a gaming house control section communicating with the detection control sections for controlling the detection control sections. Each of the matrix controllers 100 comprises a matrix sensor of detection means for detecting game play media of the gaming machines, storage means for storing detection positions for detecting the game play media, determination means for determining that a game play medium is detected by the detection means at one of the detection positions stored in the storage means, and outputting detection information indicating that the game play medium is detected at the detection position, transmission means for transmitting at least the detection information output by the determination means to the gaming house control section, reception means for receiving information from the gaming house control section, and setting means, if the information received at the reception means is information concerning the detection position, for setting the detection position in the storage means.

The matrix controller 100 is made of, for example, CPU circuitry consisting of a CPU, RAM, ROM, etc. In this case, the storage means is provided by the RAM and the determination means is provided by the CPU. The transmission means and the reception means are made of a transmission-reception circuit, and connected to the hall management computer 200 of the gaming house control section via a bus line. The hall management computer 200 and the matrix controllers 100 can make up a LAN for communicating with each other according to a predetermined protocol. If the gaming machines form an island, one bus line can be provided for each island, and when receiving a request to send from the hall management computer 200, each of the matrix controllers connected to the gaming machines forming the island can transmit the processing result to the hall management computer 200 via the bus line. Alternatively, the matrix controllers can use the bus line in a time-sharing manner for transferring data.

The hall management computer 200 comprises input means for inputting information concerning the detection positions, transmission means for transmitting at least the information concerning the detection positions input through the input means to the matrix controller 100, reception means for receiving at least the detection information from the matrix controller 100, and processing means for processing the detection information received at the reception means. One or more read means for reading the information concerning the detection positions from a storage medium storing the information concerning the detection positions can be provided as the input means. A recording media reader 270 can be provided as the read means. Floppy disks, IC cards, etc., can be used as storage media, and the information concerning the detection positions can be stored on and read from the storage media. The recording media reader 270 may further include write means that can write information onto the storage media. Stored information may be previously written onto the storage media by write means provided for other computers. Further, the hall management computer 200 can have display means such as a CRT display 240 and print means such as a printer 260.

The matrix controller 100 is previously assigned identification information (an address on the bus line, etc.,). The hall management computer 200 further includes command means for accepting a detection position transmission command to the matrix controllers 100 and the identification information of the matrix controllers 100. A ten-key pad 250, a mouse, a keyboard, etc., can be provided as the command means.

A CPU 210 can be provided as the processing means. It instructs the transmission means to transmit the information concerning the detection positions input through the input means to the matrix controller 100 corresponding to the identification information accepted through the command means. In addition, the CPU 210 performs predetermined processing for received information, abnormal information, etc., and outputs final nail adjustment data. The hall management computer 200 may further include holding means for holding different types of information concerning the detection positions. A RAM 230, an IC card, etc., can be provided as the holding means for holding the information concerning the detection positions read from storage media. The command means further accepts a selection command of the type of information held in the holding means. The processing means instructs the transmission means to transmit information concerning the detection positions held in the holding means, of the type corresponding to the selection command accepted through the command means. If an IC card is provided, driving can be performed directly from the IC card without using RAM.

The matrix controller 100 further includes processing procedure storage means for storing predetermined processing procedures and detection information processing means for processing the detection information output by the determination means according to the processing procedure stored in the processing procedure storage means and outputting the processing result. The transmission means of the matrix controller 100 transmits the processing result output by the detection information processing means. If the matrix controller 100 is made of CPU circuitry consisting of a CPU, RAM, ROM, etc., the detection information processing means can be provided by the CPU and the processing procedure storage means can be provided by the RAM.

The input means of the hall management computer 200 inputs a processing procedure in the detection information processing means and the transmission means transmits the processing procedure input through the input means. The reception means of the matrix controller 100 receives the processing procedure transmitted by the transmission means of the gaming house control section, and the setting means further determines whether or not the information received at the reception means is the processing procedure and if the information received at the reception means is the processing procedure, it can set the received processing procedure in the processing procedure storage means. The reception means of the hall management computer 200 receives the processing result, and the processing means performs processing based on the processing result received at the reception means. The matrix controller 100 can further include accumulation means for accumulating the determination result of the determination means. If the matrix controller 100 is made of CPU circuitry consisting of a CPU, RAM, ROM, etc., and the accumulation means can be provided by the RAM.

Further, the computer system in the embodiment can include a business management computer 300 in addition to the hall management computer 200. The business management computer 300 comprises processing means for processing data containing gaming house sales, transmission means for transmitting information to the hall management computer 200, and reception means for receiving information from the hall management computer 200. It can further include large-capacity storage media such as optical disk and hard disk on which sales data can be accumulated. The business management computer 300 can further have display means such as a CRT display 340, print means such as a printer 360, and command means such as a ten-key pad 350 and a keyboard.

In FIG. 1, the base board of the gaming machine 10 is provided with a guide rail for defining a gaming area. The inner area surrounded by the guide rail provides the gaming area. A large number of pins (nails) for repelling metallic bodys B are hammered into the base board in the gaming area. A plurality of winning holes are made in different points and one out hole is made on the bottom of the gaming area. The winning holes are holes for the player to enter a metallic body in for a winning game play, and through which the entered metallic body is discharged from the base board. On the other hand, the out hole is a hole into which metallic bodies that do not enter into the winning holes are finally collected for discharging the metallic bodies from the base board. As shown in FIG. 1, patterns required for game plays, such as an out hole pattern 18, winning hole patterns 15, a propelled pinball count setup point pattern 13, a central effect pattern 16, and a windmill pattern 17, are represented on the base board.

The propelling mechanism has a propelling handle 19 and a drive mechanism which is not shown. The propelling handle 19 is located on the front face of the pinball machine 10 for players to propel metallic bodies by turning the propelling handle 19 at a desired angle. Also, a game play media return for receiving metallic bodies paid out from the gaming machine 10 is located on the front face of the gaming machine 10. When a metallic body propelled into the base board enters any of the winning holes, a predetermined number of metallic bodies are paid out for the winning game play.

The detection positions of the patterns required for game plays, such as the out hole pattern 18, the winning hole patterns 15, the propelled pinball count setup point pattern 13, the central effect pattern 16, and the windmill pattern 17, are held in the storage means of the matrix controller 100 in agreement with the coordinates of the matrix sensor. Information indicating the detection positions at which to detect game play media will be hereinafter referred to as a gage. The gage is held as instructed by the hall management computer 200. That is, detection positions on the matrix are specified from the hall management computer 200 and correspond to the addresses of the winning hole positions, windmill position, out pinball detection area, propelled pinball count setup point, etc., of a given gaming machine. FIG. 7 is an illustration of the information indicating the detection positions. Winning hole numbers are assigned to the winning holes and the number of pinballs paid out for a winning game play can be set for each winning hole. The propelled pinball count setup point is attached to the tip of the game play media propelling rail for detecting propelled game play media. For the out pinball detection area, one area of the gage face is specified and game play media entering the area are counted as out pinballs.

Next, the operation for the hall management computer 200 to set the detection positions in the matrix controller 100 will be discussed.

First, a floppy disk, IC card, or any other storage medium on which the detection positions are stored is inserted into a storage media slot of the hall management computer 200. The recording media reader 270 reads information written on the storage medium and the information is held in the RAM 230. The type of read detection positions is displayed on the display 240. It corresponds to the type of gaming machine and therefore the name of the gaming machine or the like is displayed. A detection position transmission command to the matrix controller 100 and the identification information of the matrix controller 100 are accepted through the ten-key pad 250 of the command means. Further, a selection command of the type of gaming machine displayed on the display 240 is accepted through the command means, and the processing means instructs the transmission means to transmit the information concerning the detection positions of the type corresponding to the selection command accepted through the command means. Then, the transmission means of the hall management computer 200 transmits the information concerning the detection positions of the type corresponding to the selection command to the matrix controller 100 corresponding specified through the command means by adding, to the identification information, the identification information of the matrix controller 100 as destination information and information indicating detection position transmission.

The reception means of the matrix controller 100 receives the information to which its own identification information is added as the destination information. If the information received at the reception means is the information concerning the detection positions, the setting means sets the detection positions in the storage means. Whether or not it is the information concerning the detection positions can be determined by the fact that the information indicating detection position transmission has been added. Thus, the detection positions can be set for the matrix controller 100 placed for each gaming machine.

Identification information may be assigned to the gaming machines so that gaming machine identification numbers 01–29 are specified to A gage and gaming machine identification numbers 30–60 are specified to B gage through the ten-key pad 250. Further, if a plurality of gaming machines form an island, identification information may be added to each island for transmitting the same gage to all of the matrix controllers 100 in the island by specifying the identification information assigned to the island.

Next, a procedure for processing detection information in the matrix controller 100 will be discussed.

The processing procedure executed by the matrix controller 100 refers to a procedure for performing operations on the detection information output by the determination means for calculating the number of output pinballs, the number of input pinballs, etc. In the embodiment, a game play media trace provided by game play media detection information is accumulated in the accumulation means of the matrix controller 100 and operations are performed on the trace according to the processing procedure, whereby necessary information can be transmitted to the hall management controller 200 in batch form without frequently sending small amounts of data thereto, so that sufficient processing speed can be provided. The accumulation means of the matrix controller has storage locations of the same addresses as the matrix sensor; the number of passed game play media is counted for each address and the count is stored. Therefore, the count at an address through which game play media often pass increases and the count at an address through which game play media infrequently pass decreases. The matrix controller 100 calculates the number of propelled pinballs, the number of output pinballs, and the number of input pinballs from the counts, and accumulates them in the accumulation means. The accumulated information is transmitted by the transmission means to the hall management computer 200 in batch form every given time.

An example of the processing procedure will be discussed with reference to FIGS. 6 and 5.

Figure 6:
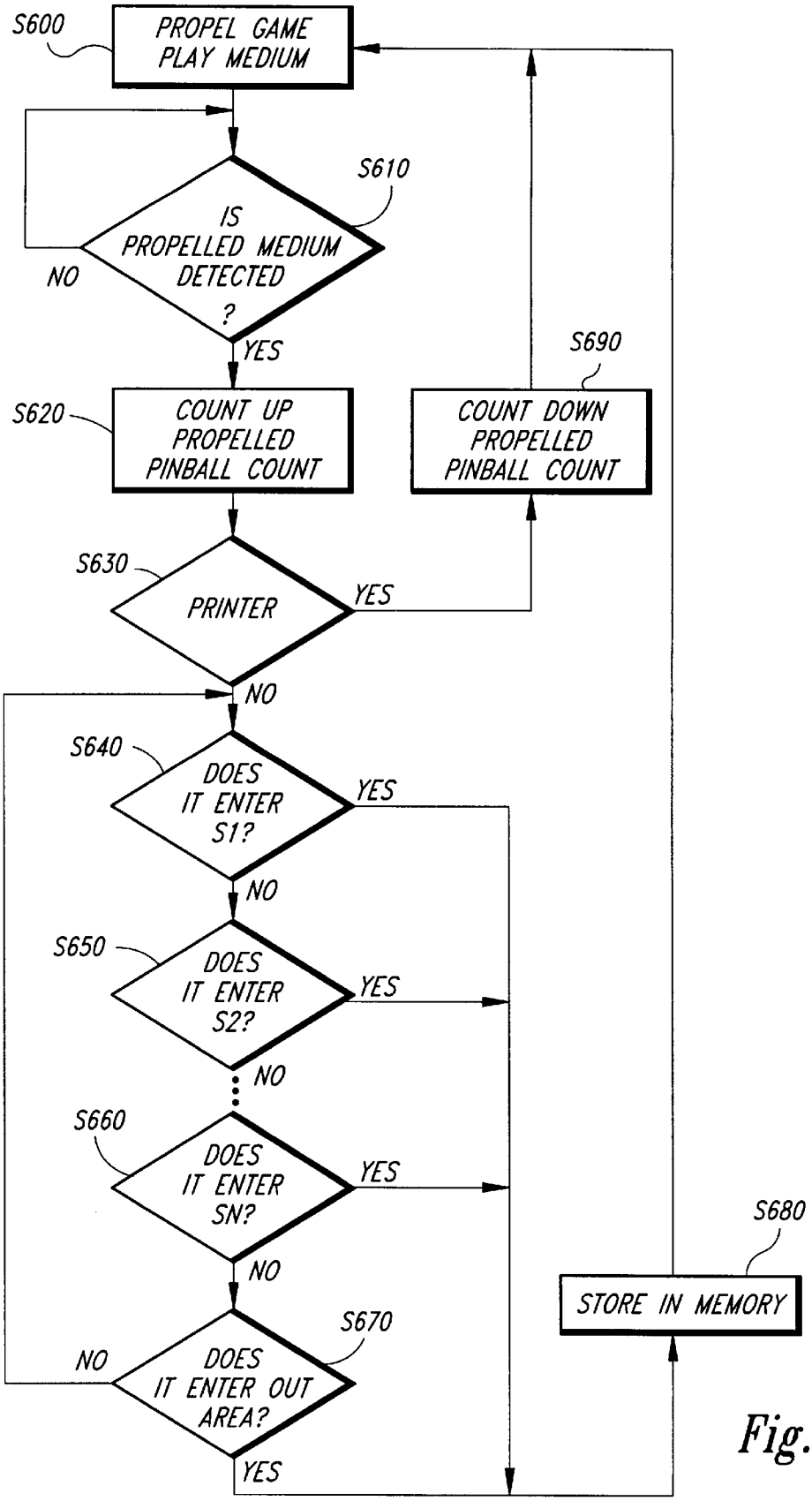
FIG. 6 is a flowchart showing a processing procedure in the matrix controller 100.

In FIG. 6, when a game play medium is detected at the propelled pinball count setup point at step S610, the processing means of the matrix controller 100 assumes a game play medium to be propelled, and counts up the propelled pinball count at step S620. The processing means determines whether or not the game play medium has been propelled normally at step S630 and if it has not been propelled normally, counts down the count at step S690. If it has been propelled normally, the processing means determines whether or not it enters one of the winning holes S1 to SN at steps S640–S660. Whether or not the game play medium has been propelled normally can be determined based on whether or not it has passed through the propelled pinball count setup point. Finally, the processing means determines whether or not game play medium enters the out hole (S670), and at step 680 stores the number of detection times in the corresponding storage location of the accumulation means according to the result of each determination. Such detection is repeated until the game is over.

Figure 5:
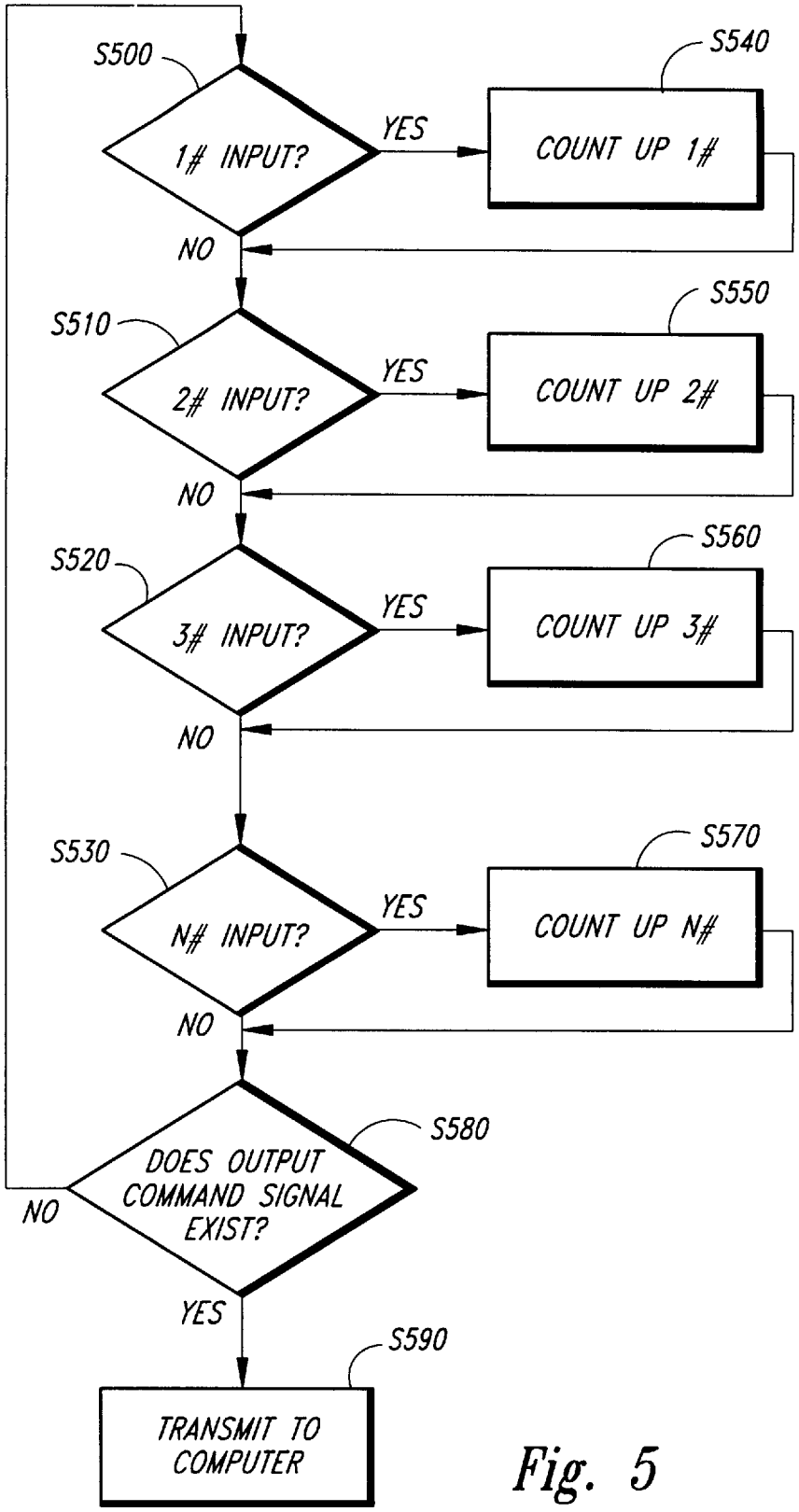
FIG. 5 is a flowchart showing a processing procedure in a matrix controller 100.

The operation when the determination results are output is performed according to a processing procedure shown in FIG. 5. In the figure, assume that detection positions 1#–n# exist. These are detection positions set in the storage means; the pinball propelling position, winning holes, out hole, etc., are set as described above. When a game play medium is detected, whether or not it is input (detected) at the setup positions 1#–n# is determined at steps S500–S530. If it is input, the value of the storage location corresponding to the detection position is counted up for counting the number of input game play media at steps S540–S570. A counter may be provided for each detection position for performing operations on the count information.

Further, if a game play medium is detected at the position corresponding to one of the winning holes, the number of won pinballs set for the winning hole can be held as the number of output pinballs, whereby the number of input pinballs and the number of output pinballs can be furthermore accumulated as information accumulated in the accumulation means. The game play media input by a player to the gaming machine are called input pinballs and the pinballs paid out to a player for a winning game play from the gaming machine are called output pinballs. The values can be found by calculation as described below. The number of won pinballs can be set in the storage means for each winning hole. It can be set finely in such a manner that when a pinball enters the winning hole S1, 15 pinballs are paid out, that when a pinball enters the winning hole S2 or S3, nine pinballs are paid out, that when a pinball enters the winning hole S4, 10 pinballs are paid out, that when a pinball enters the winning hole S5, S6, or S7, 11 pinballs are paid out, etc.

| | |
|---|---|
| Number of input pinballs = | number of propelled pinballs = pinballs entering a winning hole + pinballs entering out hole (count) . . . 1 |
| Number of output pinballs = | pinballs entering a winning hole × number of won pinballs set per pinball entering a winning hole . . . 2 |

The processing procedures as described above are prepared as programs, etc. These processing procedures can be set from the hall management computer 200 in a similar manner to that of setting the detection positions described above. In this case, information indicating the processing procedures is added to the processing procedures for transmission from the transmission means of the hall management computer 200. When the information indicating the processing procedures is detected upon reception, the setting means sets the processing procedures in the RAM, etc., of the processing procedure storage means. The information accumulated in the accumulation means can be sent out in batch form from the matrix controller 100 to the hall management computer 200.

Thus, after gaming machines are replaced, the matrix sensor is fitted into the inner glass guide and the gage and/or processing procedure matching the gaming machine can be set from the hall management computer.

Next, each process for a player to play a game at a gaming machine will be discussed.

First, a game play medium propelled by the player at the gaming machine shown in FIG. 1 passes between the base board formed with the nails, windmills, winning holes, out hole, etc., and the matrix sensor, as a game progresses.

When the game play medium comes to the intersection of the transmission line where transmission current flows and the reception line selected by scanning, impedance of the matrix sensor changes and a signal is generated on the reception circuit. Although the game play medium moves at high speed, the matrix sensor scans at a higher speed, so that the movement of the game play medium can be detected for each cell of the matrix. A signal output from the matrix sensor is input to the matrix controller.

The matrix controller, which inputs the game play medium position, etc., accumulates the detection result in the accumulation means as described below, next processes the detection result according to the processing procedure specified by the hall management computer 200.

The matrix controller inputs the game play medium detection signal according to the processing procedure shown in FIG. 6. The matrix controller, which contains storage locations assigned with the same addresses as the cells of the matrix, counts the number of passed game play media for each address and stores the number of game play media according to the processing procedure shown in FIG. 5. That is, each signal output from the matrix sensor is input to the matrix controller and whenever a game play medium passes through a setup address, for example, the number of propelled pinballs, the number of pinballs entering a winning hole, and the number of pinballs entering the out hole shown in FIG. 6 are calculated according to the information set in the storage means, and the results are further accumulated in the accumulation means as the number of propelled pinballs, the number of output pinballs, and the number of input pinballs.

The positions of the windmill, winning holes, and out hole on the matrix and the detection positions of the propelled pinball count setup point, etc., are preset in the storage means, whereby the matrix controller can detect how many game play media are propelled into the base board, where the game play media disappear, and through what path. The count at an address through which game play media often pass increases and the count at an address through which game play media pass less frequently decreases, based on which the number of propelled pinballs, and to which hole and through what path each game play medium enters, namely, the propriety and feature of nail adjustment and which safe holes game play media enter can be detected accurately.

In addition, an empty contact signal, lent pinball signal, remaining amount signal, etc., may be input to the matrix controller. The "empty contact signal" is a signal detecting the presence or absence of a game play medium at a game play media replenishment counter 14 disposed on an upper tray on the rear of the gaming machine. The "lent pinball signal" indicates how many game play media a player borrows for playing games in cash as the number of game play media or an amount. The "remaining amount signal" is used for security in a gaming machine system of the type wherein the pinball lending machine is a pinball lending machine with a large denomination bill and if a player inputs a large denomination bill such as 5000 or 10000 yen and borrows pinballs to the value of as much as 1000 yen, change is not paid out at that time but stored as the "remaining amount." The player then handles an adjustment switch at the time of game end and takes a paid-out card, on which the number of won pinballs and the most recent remaining amount are recorded, to the prize exchange counter for exchanging the card for a prize and receiving the remaining amount returned from the gaming house.

The signals accumulated in the accumulation means are transmitted by the transmission means to a business level computer in batch form every given time. The accumulated signals include the number of input pinballs, the number of output pinballs, the empty contact signal, the lent pinball signal, etc. The signals can be transmitted upon receipt of a transmission request from the hall management computer 200. If a condition such as a closed condition or an abnormal condition occurs in the matrix controller 100, even if a transmission request is not received, an interrupt signal can be generated as an emergency signal for immediately informing the hall management computer 200 of the condition.

When the hall management computer 200 determines that a predetermined condition is reached from the number of input pinballs and the number of output pinballs received from all matrix controllers, it can forcibly close the corresponding gaming machine for terminating the game play. For example, if the number of output pinballs reaches a predetermined number, a signal is immediately issued to the corresponding gaming machine so as to disable game play media from being propelled (to close the gaming machine). The hall management computer 200 performs operations on data concerning a close and finally outputs nail adjustment data. The gaming machine nails are adjusted according to the nail adjustment data for pursuing ways to raise the fun level of the gaming machine within the range of economic conditions. The hall management computer 200 can transmit a replenishment signal, a closed signal, etc., in addition to the information concerning the detection positions and the processing procedures. That is, the hall management computer 200 can respond to an empty contact signal with a replenishment signal for replenishing the upper tray of the gaming machine with game play media or if a closed condition is reached from the number of input pinballs and the number of output pinballs, it can output a closed signal for stopping the operation of the gaming machine for automatically or manually closing the gaming machine.

In the matrix controller 100, if the detection result reaches a predetermined condition, the gaming machine can also be closed to forcibly terminate the game play, whereby the gaming machine can be closed smoothly even if an instruction from the hall management computer 200 is delayed.

Further, the business management computer 300 can process data containing sales from information collected by the hall management computer 200.

Thus, according to the embodiment, the information concerning the detection positions and the processing procedures can be set for each matrix controller from the hall management computer 200.

Thus, according to the invention, the computer system in the gaming house facilitates setting the detection positions of the detection means in each gaming machine and also setting the processing procedures for processing the information detected by the detection means in each gaming machine.

I claim:

1. A computer system in a gaming house having a plurality of gaming machines for players to play games with game play media, said computer system comprising:

detection control sections, each located in a respective one of said gaming machines, for controlling detection of the game play media of the gaming machines; and a gaming house control section in communication with each of the detection control sections and for controlling the detection control sections, wherein each of said detection control sections comprises:

sensing means for sensing the game play media at a plurality of sensing positions of the gaming machine;

storage means for storing detection positions at which to detect the game play media, the detection positions corresponding to one or more of the sensing positions;

determination means for determining that one game play medium is sensed by said sensing means at one of the sensing positions that corresponds to one of the detection positions stored in said storage means, and for outputting detection information indicating that the game play medium is detected at the detection position;

first means for transmitting at least the detection information output by said determination means to said gaming house control section;

first means for receiving detection position information specifying the detection positions from said gaming house control section; and setting means for storing the detection positions specified by the detection position information received at the receiving means in said storage means, and wherein said gaming house control section comprises:

means for inputting the detection position information;

second means for transmitting at least the detection position information input through said inputting means to each of said detection control sections;

second means for receiving at least the detection from said detection control sections; and means for processing the detection information received at said second receiving means.

2. The computer system as claimed in claim 1 wherein said inputting means comprises one or more read means for reading the detection position information from a storage medium storing the detection position information.

3. The computer system as claimed in claim 1 wherein each of said detection control sections is previously assigned identification information, wherein said gaming house control section further includes command means for accepting a detection position information transmission command to one of said detection control sections and the identification information of said detection control section, and further includes processing means for instructing said second transmission means to transmit the detection position information input through said inputting means to said detection control section corresponding to the identification information accepted through said command means.

4. The computer system as claimed in claim 3 wherein said gaming house control section further includes means for holding detection position information for multiple detection-position layouts.

5. The computer system as claimed in claim 4 wherein said command means further accepts a selection command corresponding to a selected one of said layouts, and wherein said processing means, in response to said selection command, instructs said second transmission means to transmit the detection position information that is held in said holding means and that corresponds to the selected layout.

6. The computer system as claimed in claim 1 wherein said sensing means is a metal sensor comprising a flat sensing matrix consisting of a plurality of parallel turned transmission lines mounted on one side of a substrate and a plurality of parallel turned reception lines placed on the substrate in a direction crossing the transmission lines such that an electromagnetic coupling between a reception line and a transmission line fluctuates when a metal object is located at an intersection of the reception line and the transmission line, and wherein said storage means stores coordinates on the sensing matrix as the detection positions.

7. The computer system as claimed in claim 1 wherein said each detection control section further includes:

means for storing predetermined processing procedures;

detection information processing means for processing the detection information output by said determination means according to the processing procedure stored in said processing procedure storage means, for generating a process result, and for outputting the processing result; and wherein said first transmitting means of said detection control section transmits the processing result output by said detection information processing means to said gaming house control section.

8. The computer system as claimed in claim 7 wherein said second receiving means of said gaming house control section receives said processing result, and wherein said processing means performs processing based on the processing result received at the second receiving means.

9. The computer system as claimed in claim 7 wherein said inputting means of said gaming house control section inputs a processing procedure for said detection information processing means, wherein said second transmitting means of said gaming house control section transmits the processing procedure input through said inputting means, wherein said first receiving means of said detection control section receives the processing procedure transmitted by said second transmitting means of said gaming house control section, and wherein said setting means stores the processing procedure received at said first receiving means in said processing procedure storage means.

10. A computer system in a gaming house having a plurality of gaming machines for players to play games with game play media, said computer system comprising:

detection control sections, each being placed in each of the gaming machines, for controlling detection of the game play media of the gaming machines; and a gaming house control section communicating with each of said detection control sections for controlling the detection control sections, wherein each of said detection control sections comprises:

sensing means for sensing the game play media at a plurality of sensing positions of the gaming machine;

storage means for storing detection positions at which to detect the game play media, the detection positions corresponding to at least one of the sensing positions;

determination means for determining that one game play medium is sensed by said sensing means at one of the sensing positions corresponding to one of the detection positions stored in said storage means, and for outputting detection information indicating that the game play medium is detected at the detection position;

means for storing predetermined processing procedures;

detection information processing means for processing said detection information output by said determination means according to one of the processing procedures stored in the processing procedure storage means, and for generating and outputting a processing result;

first means for transmitting at least the processing result output by the detection information processing means to the gaming house control section;

first means for receiving a processing procedure transmitted from said gaming house control section; and setting means for storing the processing procedure received at the receiving means in said processing procedure storage means, and wherein said gaming house control section comprises:

means for inputting the processing procedure for said detection information processing means;

second means for transmitting at least the processing procedure input through the inputting means to each of the detection control sections;

second means for receiving at least said processing results from each of said detection control sections; and means for processing the processing result received at the second receiving means.

11. A detection control system for controlling detection of game play media of the gaming machine for a player to play a game with the game play media;

said detection control system being placed in a gaming machine and comprising:

sensing means for sensing the game play media at a plurality of sensing positions of the gaming machine;

storage means for storing detection positions game play media at which game play media are detected;

determination means for determining that one game play medium is sensed by said sensing means at one of the sensing positions corresponding to one of the detection positions stored in the storage means, and for outputting detection information indicating that the game play medium is detected at the detection position;

means for transmitting a first remote location that is external to the detection control system, at least said detection information output by said determination means;

means for receiving detection position information specifying said detection positions from a second remote location that is external to the detection control system; and setting means for storing the detection positions specified by the received detection position information in said storage means.

* * * * *